US009260272B2

(12) United States Patent
Lin

(10) Patent No.: US 9,260,272 B2
(45) Date of Patent: Feb. 16, 2016

(54) YARN CYLINDER

(71) Applicant: Ying-Ling Lin, Taoyuan County (TW)

(72) Inventor: Ying-Ling Lin, Taoyuan County (TW)

( * ) Notice: Subject to any disclaimer, the term of this patent is extended or adjusted under 35 U.S.C. 154(b) by 233 days.

(21) Appl. No.: 13/754,934

(22) Filed: Jan. 31, 2013

(65) Prior Publication Data

US 2014/0208804 A1 Jul. 31, 2014

(51) Int. Cl.
*B65H 75/28* (2006.01)
*B65H 65/00* (2006.01)
*B65H 75/10* (2006.01)

(52) U.S. Cl.
CPC ..... *B65H 75/28* (2013.01); *B65H 65/00* (2013.01); *B65H 75/10* (2013.01); *B65H 2701/31* (2013.01); *B65H 2701/5122* (2013.01)

(58) Field of Classification Search
CPC ..... B65H 65/005; B65H 75/28; B65H 75/285
USPC ..... 242/476.1, 476.5, 476.6, 579, 587, 242/587.2, 125, 125.1
See application file for complete search history.

(56) References Cited

U.S. PATENT DOCUMENTS

| | | | | |
|---|---|---|---|---|
| 3,767,129 | A * | 10/1973 | Sobel | 242/476.6 |
| 6,412,728 | B1 * | 7/2002 | Jen | 242/476.6 |
| 6,779,750 | B1 * | 8/2004 | Couchey et al. | 242/476.6 |
| 6,926,222 | B2 * | 8/2005 | Rummage | 242/476.6 |
| 7,832,675 | B2 * | 11/2010 | Bumgarner et al. | 242/474.7 |
| 2003/0209628 | A1 * | 11/2003 | Rummage | 242/476.6 |

* cited by examiner

*Primary Examiner* — William E Dondero

(57) ABSTRACT

The yarn cylinder includes a hollow cylindrical body; a groove, almost annularly disposed around the cylindrical body, being formed with four sections of teeth to define four segments; and a plurality of recesses, located beside the groove one by one, each recess having a tapered end, and all tapered ends being toward the same direction.

1 Claim, 6 Drawing Sheets

YARN CYLINDER

BACKGROUND OF THE INVENTION

1. Technical Field

The invention relates to filatures.

2. Related Art

Please refer to FIGS. 1-4, which show a typical yarn cylinder. The yarn cylinder is made of plastic and is formed with a groove 1. The groove 1 is of a C-shape with about 350 degrees. Two ends of the groove 1 are separately formed with two guiding slants 11. The groove 1 is formed with four sections of teeth 30, 40, 50, 60 to define four segments 3, 4, 5, 6. Directions of two adjacent sections of teeth 30, 40, 50, 60 are different from each other.

A division line 300, 400, 500, 600 is defined between every two adjacent sections of teeth 30, 40, 50, 60. Directions of two adjacent sections of teeth 30, 40, 50, 60 meet at an angle. However, the groove 1 with the guiding slants 11 is too narrow, so yarn is not easy to enter the groove 1. And the guiding slants 11 do not have enough holding ability.

SUMMARY OF THE INVENTION

An object of the invention is to provide an improved yarn cylinder, which allows yarn to easily enter the groove and can firmly hold yarn.

To accomplish the above object, the yarn cylinder of the invention includes a hollow cylindrical body; a groove, almost annularly disposed around the cylindrical body, being formed with four sections of teeth to define four segments; and a plurality of recesses, located beside the groove one by one, each recess having a tapered end, and all tapered ends being toward the same direction.

DETAILED DESCRIPTION OF THE INVENTION

Figure 1:
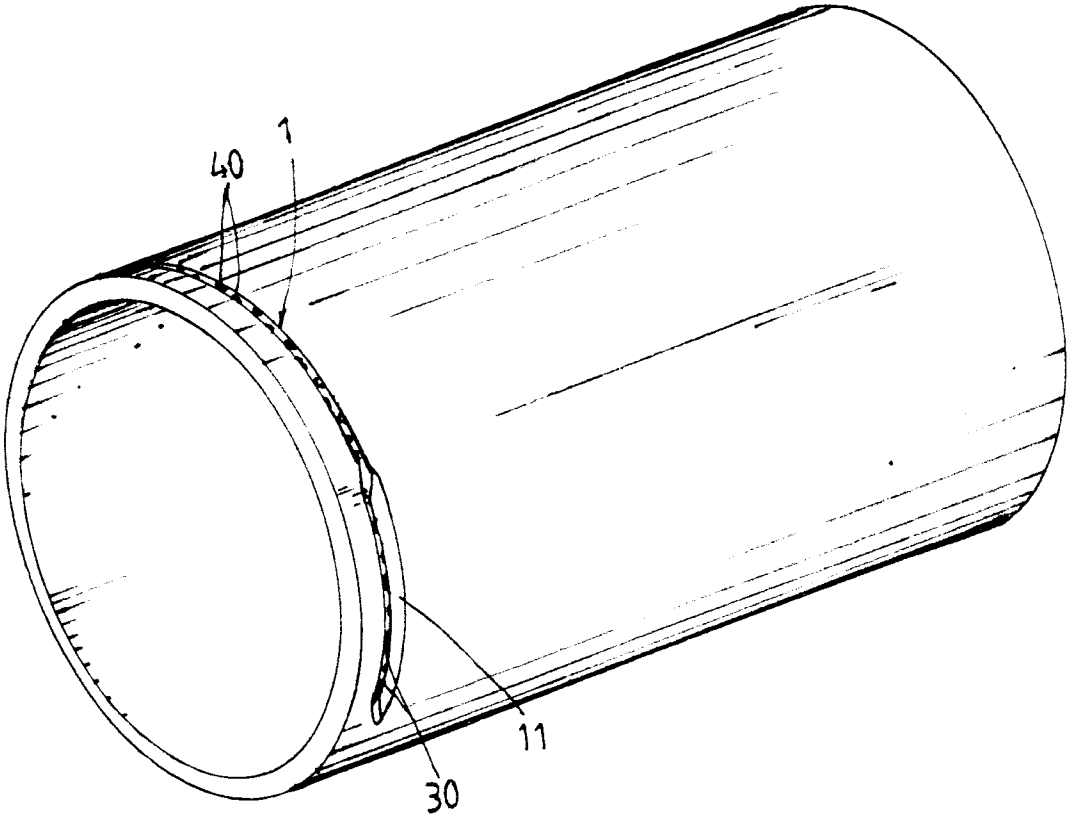
Fig.1 Prior Art
FIG. 1 is a perspective view of a typical yarn cylinder.
Figure 3:
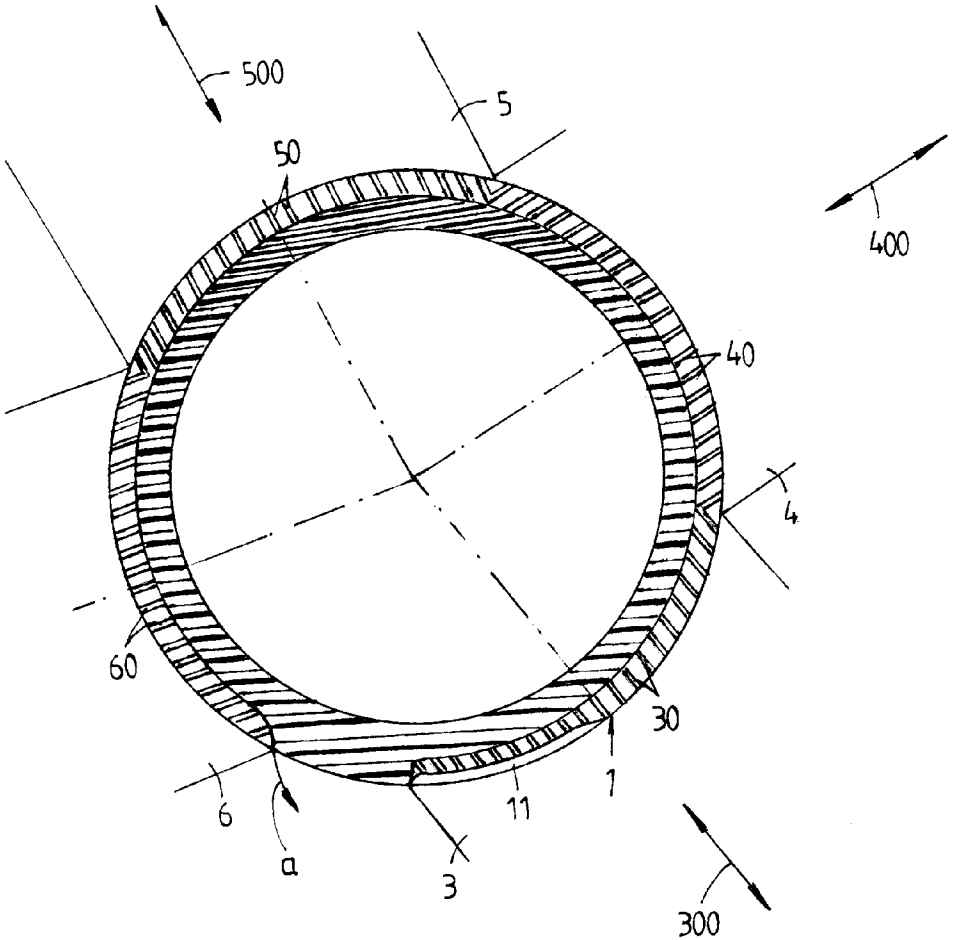
Fig.3 Prior Art
FIG. 3 is a cross sectional view of the typical yarn cylinder.
Figure 2:
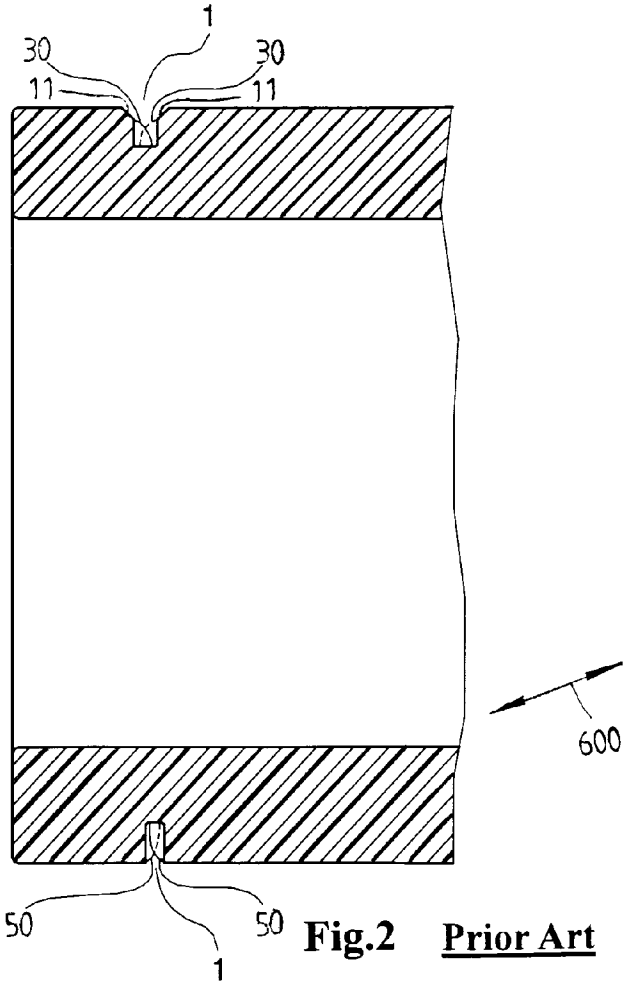
Fig.2 Prior Art
FIG. 2 is a longitudinal sectional view of the typical yarn cylinder.
Figure 4:
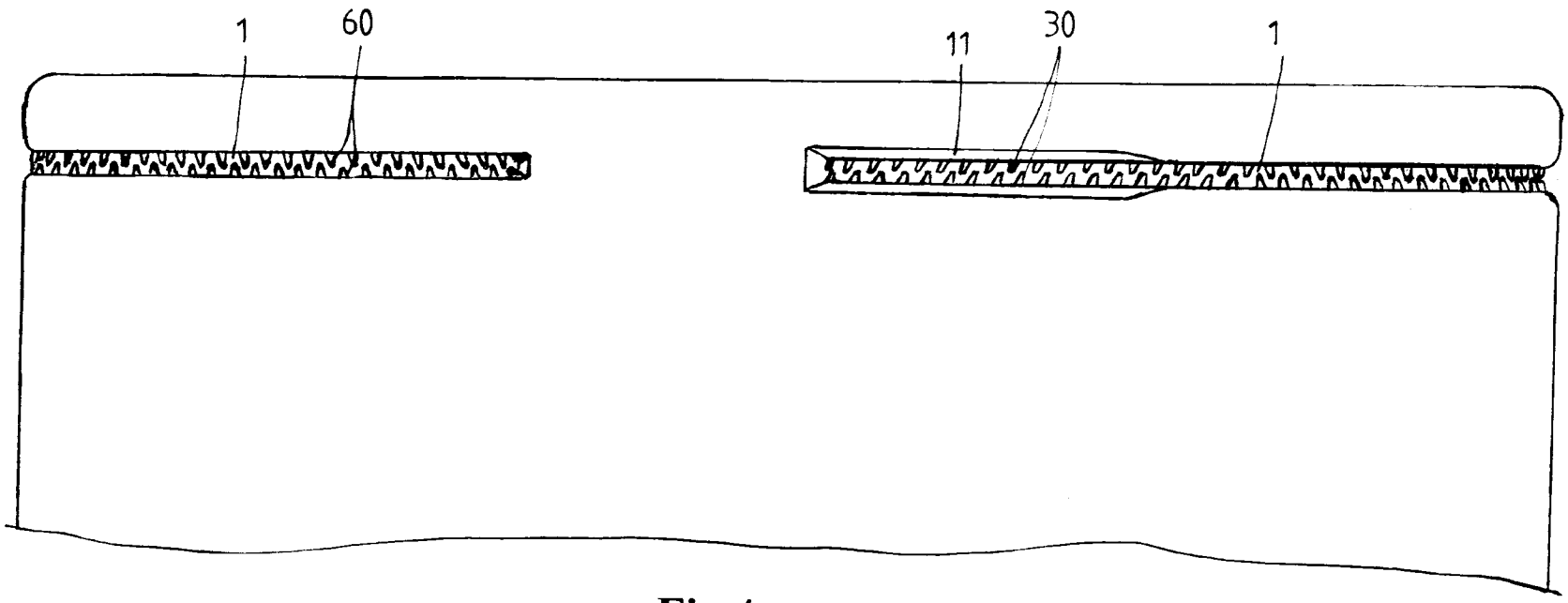
Fig.4 Prior Art
FIG. 4 is a top view of the typical yarn cylinder.
Figure 5:
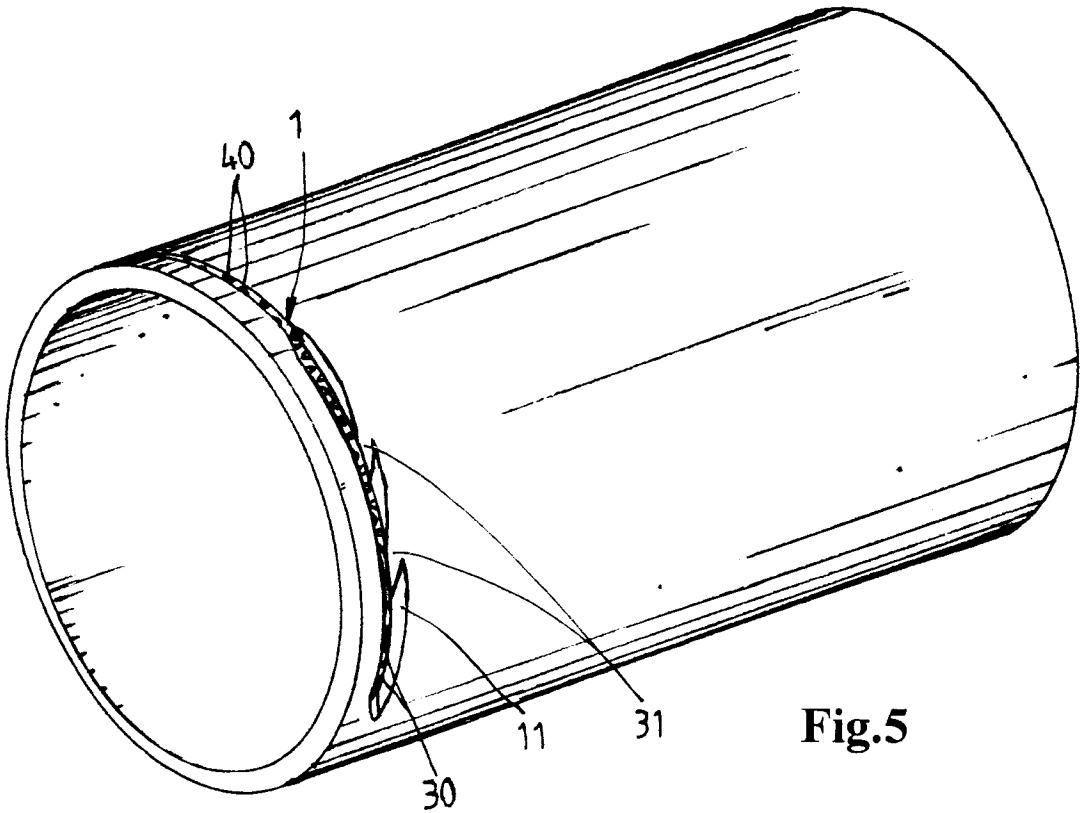
FIG. 5 is a perspective view of the invention.

Please refer to FIGS. 5-8. As shown, the improved yarn cylinder of the invention includes a hollow cylindrical body. A groove 1 is almost annularly disposed around the cylindrical body. The groove 1 is of a C-shape and formed with four sections of teeth 30, 40, 50, 60 to define four segments 3, 4, 5, 6. A plurality of recesses 31 are formed beside the groove 1 one by one. Each recess 31 has a tapered end and a guiding slant 11, and all tapered ends are toward the same direction. This arrangement allows yarn (a) to easily enter the groove 1 and can firmly hold the yarn (a).

Figure 7:
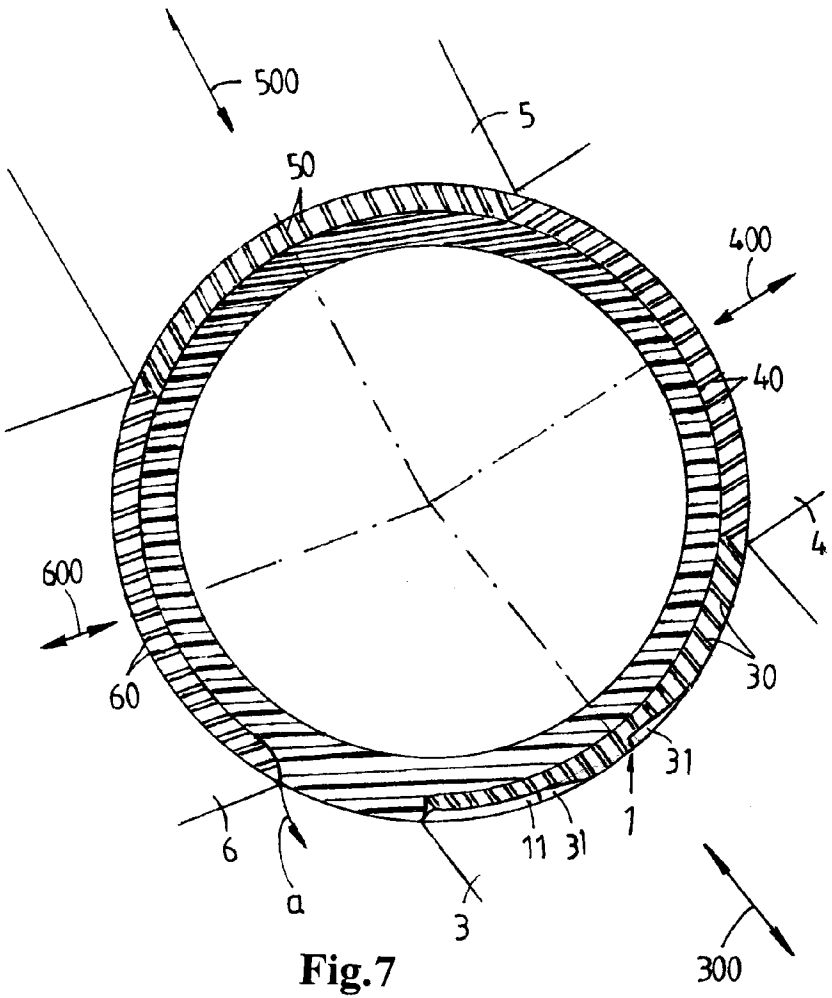
FIG. 7 is a cross sectional view of the invention.
Figure 6:
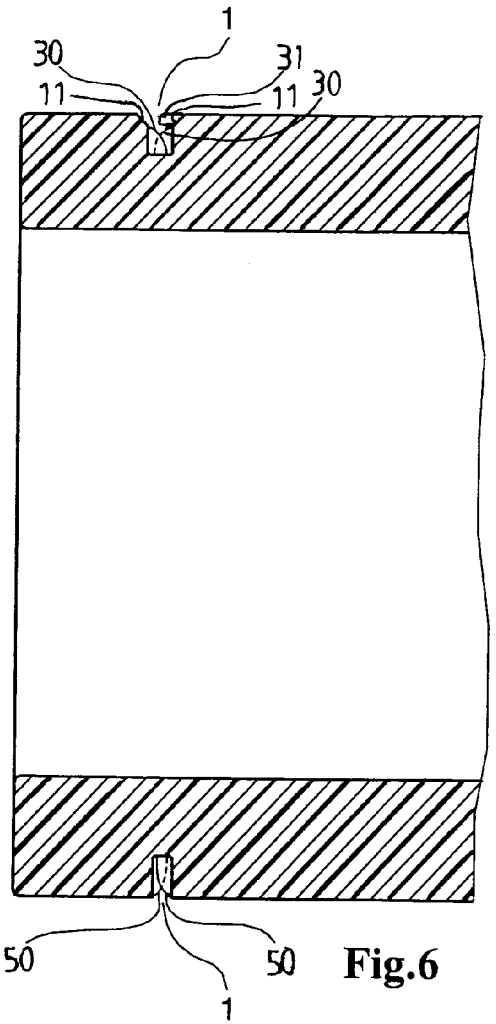
FIG. 6 is a longitudinal sectional view of the invention.
Figure 8:
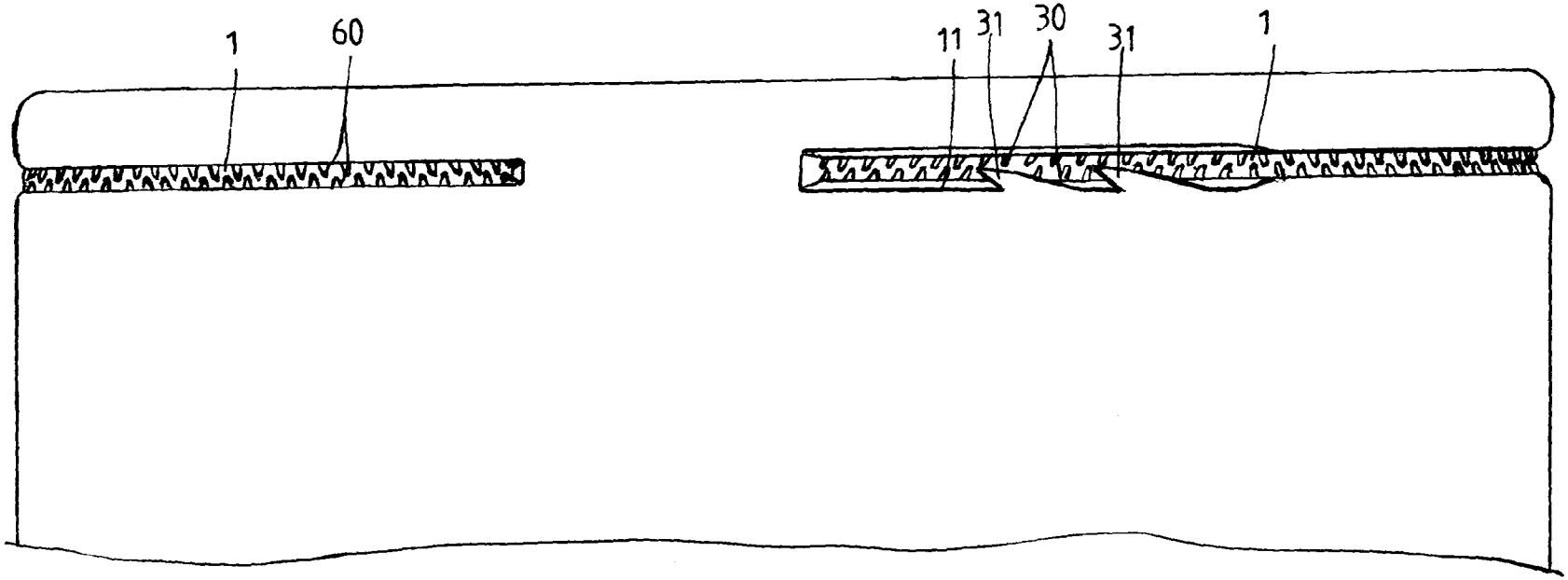
FIG. 8 is a top view of the typical yarn cylinder.

Please refer to FIG. 7. The yarn (a) can be easily wound in the groove 1 through the guiding slants 11 of recesses 31. The yarn (a) cannot escape from the groove 1 because the four sections of teeth 30, 40, 50, 60 in the four segments 3, 4, 5, 6 and the recesses 31 compose an interlaced holder. By the arrangement of the invention, the yarn (a) can be easily guided into the groove 1 but the yarn (a) is hard to escape from the groove 1.

It will be appreciated by persons skilled in the art that the above embodiment has been described by way of example only and not in any limitative sense, and that various alterations and modifications are possible without departure from the scope of the invention as defined by the appended claims.

What is claimed is:

1. A yarn cylinder comprising:

a hollow cylindrical body;

a groove, almost annularly disposed around the cylindrical body, being formed with four sections of teeth to define four segments, and having a first side and a second side, wherein the first and second sides are straightly parallel, a distance of the first and second sides is substantially identical, and the teeth are crookedly toward an inside of the groove; and a plurality of recesses, located on the first side of the groove one by one, each recess having an acutely tapered end and a guiding slant, and all tapered ends being angled toward the same direction which is different from a direction of the teeth, wherein the second side of the groove is provided with no recess.

* * * * *